US005605749A

United States Patent [19]

Pike et al.

[11] Patent Number: 5,605,749

[45] Date of Patent: Feb. 25, 1997

[54] NONWOVEN PAD FOR APPLYING ACTIVE AGENTS

[75] Inventors: Richard D. Pike, Norcross; John W. Fowler, Marietta, both of Ga.

[73] Assignee: Kimberly-Clark Corporation, Neenah, Wis.

[21] Appl. No.: 363,096

[22] Filed: Dec. 22, 1994

[51] Int. Cl.[6] ..... D04H 1/04

[52] U.S. Cl. ..... 442/60; 428/144; 15/230.12; 15/209.1; 442/96; 442/100; 442/118; 442/119; 442/123

[58] Field of Search ..... 428/296, 144, 428/284, 286, 289; 15/230.12, 209.1

[56] References Cited

U.S. PATENT DOCUMENTS

| | | | |
|---|---|---|---|
| Re. 30,061 | 7/1979 | Sheperd | 156/78 |
| 2,958,593 | 11/1960 | Hoover et al. | 51/295 |
| 3,287,222 | 11/1966 | Larde et al. | 167/84 |
| 3,320,196 | 5/1967 | Rogers | 260/27 |
| 3,537,121 | 11/1970 | McAvoy | 15/230.12 |
| 3,567,118 | 3/1971 | Sheperd et al. | 239/6 |
| 3,619,280 | 11/1971 | Scheuer | 117/154 |
| 3,619,842 | 11/1971 | Maierson | 15/104.93 |
| 3,692,618 | 9/1972 | Dorschner et al. | 161/72 |
| 3,802,817 | 4/1974 | Matsuki et al. | 425/66 |
| 3,818,533 | 6/1974 | Scheuer | 15/104.93 |
| 3,849,241 | 11/1974 | Butin et al. | 161/169 |
| 3,910,284 | 10/1975 | Orentreich | 128/355 |
| 3,954,642 | 5/1976 | Schwuger | 252/91 |
| 3,965,519 | 6/1976 | Hermann | 15/104.93 |
| 4,112,167 | 9/1978 | Dake et al. | 428/154 |
| 4,117,187 | 9/1978 | Adams et al. | 428/286 |
| 4,142,334 | 3/1979 | Kirsch et al. | 51/395 |
| 4,189,395 | 2/1980 | Bland | 252/91 |
| 4,298,649 | 11/1981 | Meitner | 428/198 |
| 4,307,143 | 12/1981 | Meitner | 252/91 |
| 4,340,563 | 7/1982 | Appel et al. | 264/518 |
| 4,343,133 | 8/1982 | Daniels et al. | 53/341 |
| 4,376,148 | 3/1983 | McCartney | 428/198 |
| 4,401,712 | 8/1983 | Morrison | 428/289 |
| 4,421,812 | 12/1983 | Plant | 428/152 |
| 4,436,780 | 3/1984 | Hotchkiss et al. | 428/198 |
| 4,462,981 | 7/1984 | Smith | 424/27 |
| 4,473,611 | 9/1984 | Haq | 428/198 |
| 4,511,605 | 4/1985 | McCartney | 427/246 |
| 4,525,410 | 6/1985 | Hagiwara et al. | 428/198 |
| 4,525,411 | 6/1985 | Schmidt | 428/198 |
| 4,550,035 | 10/1985 | Smith | 427/398.1 |
| 4,559,157 | 12/1985 | Smith et al. | 252/90 |
| 4,578,414 | 3/1986 | Sawyer et al. | 524/310 |
| 4,587,154 | 5/1986 | Hotchkiss et al. | 428/195 |
| 4,622,258 | 11/1986 | Mencke | 428/171 |
| 4,627,936 | 12/1986 | Gould et al. | 252/558 |
| 4,657,691 | 4/1987 | Hara et al. | 252/91 |
| 4,663,220 | 5/1987 | Wisneski et al. | 428/221 |
| 4,683,001 | 7/1987 | Floyd et al. | 106/3 |
| 4,735,739 | 4/1988 | Floyd et al. | 252/91 |
| 4,753,834 | 6/1988 | Braun et al. | 428/74 |
| 4,769,022 | 9/1988 | Chang et al. | 604/368 |
| 4,775,582 | 10/1988 | Abba et al. | 428/288 |
| 4,781,974 | 11/1988 | Bouchette et al. | 428/288 |
| 4,793,941 | 12/1988 | Serbiak et al. | 252/91 |
| 4,810,556 | 3/1989 | Kobayashi et al. | 428/152 |
| 4,814,099 | 3/1989 | Lloyd | 252/91 |
| 4,833,003 | 5/1989 | Win et al. | 428/198 |
| 4,837,079 | 6/1989 | Quantrille et al. | 428/288 |
| 4,865,755 | 9/1989 | Lloyd | 252/91 |
| 4,867,831 | 9/1989 | Sigl | 156/283 |
| 4,904,524 | 2/1990 | Yoh | 428/311.3 |
| 4,917,920 | 4/1990 | Ono et al. | 427/389.9 |
| 4,919,835 | 4/1990 | Sigl et al. | 252/91 |
| 4,931,200 | 6/1990 | Shanklin et al. | 252/91 |
| 4,935,295 | 6/1990 | Serafini | 428/286 |
| 4,939,016 | 7/1990 | Radwanski et al. | 428/152 |
| 4,946,617 | 8/1990 | Sheridan et al. | 252/91 |
| 5,030,375 | 7/1991 | Sigl et al. | 252/91 |
| 5,053,157 | 10/1991 | Lloyd | 252/91 |
| 5,057,361 | 10/1991 | Sayovitz et al. | 428/290 |
| 5,091,102 | 2/1992 | Sheridan | 252/91 |
| 5,094,770 | 3/1992 | Sheridan et al. | 252/91 |
| 5,116,524 | 5/1992 | Carduck et al. | 252/90 |
| 5,270,107 | 12/1993 | Gessner | 428/296 |
| 5,284,704 | 2/1994 | Kochesky et al. | 428/296 |
| 5,302,443 | 4/1994 | Manning et al. | 428/296 X |
| 5,302,446 | 4/1994 | Horn | 428/286 |
| 5,418,045 | 5/1995 | Pike et al. | 428/296 X |
| 5,424,115 | 6/1995 | Stokes | 428/296 X |
| 5,462,793 | 10/1995 | Isoda et al. | 428/296 X |
| B1 4,615,937 | 6/1990 | Bouchette | 428/288 |

*Primary Examiner*—Daniel Zirker
*Attorney, Agent, or Firm*—Michael U. Lee

[57] ABSTRACT

The present invention provides an topically appliable active agent impregnated nonwoven pad, and the pad is fabricated from a nonwoven web that contains crimped conjugate fibers of spunbond fibers or staple fibers, wherein the nonwoven web is characterized as having autogenous inter-fiber bonds at the crossover contact points of its fibers throughout the web. The invention additionally provides a method of cleaning or buffing a solid surface with the nonwoven web.

21 Claims, No Drawings

NONWOVEN PAD FOR APPLYING ACTIVE AGENTS

BACKGROUND OF THE INVENTION

This invention is related to a pad for applying topically appliable active agents. More particularly, the invention is related to a disposable nonwoven pad that is used to carry, apply and work topically appliable active agents, for example, polishing and cleaning agents.

There are many different nonwoven products that are designed and produced to carry and/or work surface active agents. For example, there are nonwoven pads that are designed to apply and work surface active agents, such as polishing wax and dermatological medicaments. U.S. Pat. Nos. 3,537,121 and 3,910,284, for example, disclose a buffing pad that cleans or restores luster without scratching or abrading the target surface that is being cleaned or buffed. The buffing pad is fabricated from a synthetic fiber web that is bonded with an external elastomeric binder. Although this type of buffing pad is highly useful, the use of an external binder not only complicates the production process of the pads but also the selection of the external binder must be carefully made to ensure durability of the pad and physical and chemical compatibilities of the binder with the fibers forming the pad. In addition, the binder must not hinder the performance of the nonwoven pad.

Another group of active agent nonwoven products are nonwoven webs that carry active agents for various applications. For example, U.S. Pat. Nos. 4,793,941 to Serviak et al. and 5,053,157 to Lloyd disclose a laundry detergent impregnated nonwoven web which is highly suitable for delivering a proper amount of detergent for each wash load. U.S. Pat. No. 4,775,582 to Abba et al. discloses a meltblown nonwoven wet wipe for personal care uses. U.S. Pat. No. 4,683,001 to Floyd discloses an automotive wash and dry wipe that contains a polishing composition. U.S. Pat. No. 3,965,519 to Hermann discloses a disposable floor wiper, preferably of a natural fiber web, which is impregnated with a floor-coating composition. Although the prior art active agent impregnated nonwoven pads of microfibers and natural fibers are highly useful, they may not be particularly suitable for certain applications in which a large amount of an active agent needs to be delivered and/or high strength and abrasion resistance are required.

For heavy duty wiping and polishing applications, it is desirable that an active agent applying or polishing pad exhibits high strength properties as well as has a capacity for carrying a large amount of active agents compared to the weight of the pad. It is also desirable for the polishing pad to have a compressible resiliency such that the amount of release of the active agent applied on the pad can be controlled by applying varying levels of hand pressure and that a portion of the released active agent can be re-absorbed when the pressure is reduced should more than necessary amount was released. It is also highly important for economical reasons that the interfiber structure of the pad allows thorough release of the absorbed active agent during use such that the used pad does not retain a significant amount of the agent. In addition, it is highly desirable for the pad to have high physical strength and abrasion resistance such that the pad can be used to apply and spread the active agent on the target surface as well as buff or polish the surface. Furthermore, it is desirable to have the pad produced from a non-abrasive material such that the pad does not abrade or damage the finishing of the target surface. For example, an automotive polishing pad should desirably be able to carry a sufficient amount of a polishing agent for at least one complete application and is made from a non-abrading material such that the painted surface is not scratched or damaged from the use of the pad. Additionally, it is highly desirable for the pad to have sufficient strength to be useful not only as an applicator of the polishing agent but also as a buffing or polishing pad.

SUMMARY OF THE INVENTION

There is provided in accordance with the present invention an active agent impregnated nonwoven pad, which is impregnated with a topically appliable active agent. The pad is fabricated from a nonwoven web that contains crimped conjugate fibers of spunbond fibers or staple fibers. The nonwoven web can be characterized as having autogenous interfiber bonds at the crossover contact points of its fibers throughout the web, wherein the nonwoven pad is impregnated with a topically appliable active agent. Desirably, the crimped conjugate fibers of the present invention have at least 2 crimps per extended inch (2.54 cm) as measured in accordance with ASTM D-3937-82.

The present invention additionally provides a method of cleaning or buffing a solid surface. The method has the steps of applying a cleaning or polishing agent on the solid surface, and spreading and rubbing the agent against the surface with a crimped conjugate fiber nonwoven web, wherein the nonwoven web contains crimped conjugate fibers selected from spunbond fibers and staple fibers. The conjugate fibers having at least 2 crimps per extended inch (2.54 cm) as measured in accordance with ASTM D-3937-82, and the nonwoven web containing autogenous interfiber bonds at the crossover contact points of the conjugate fibers throughout the web.

The nonwoven pad of the present invention is highly suitable for polishing and buffing applications. In addition, the pad, which has a porous, lofty structure and yet exhibits high resilience, strength and abrasion resistance, is adapted for impregnating a large amount of active agents and for evenly and selectively applying the impregnated active agents. The pad is also nonabrasive and gentle enough for polishing typical solid target surfaces.

The term "spunbond fibers" as used herein indicates fibers formed by extruding molten thermoplastic polymers as filaments from a plurality of relatively fine, usually circular, capillaries of a spinneret, and then rapidly drawing the extruded filaments by an eductive or other well-known drawing mechanism to impart molecular orientation and physical strength to the filaments. The drawn fibers are deposited onto a collecting surface in a highly random manner to form a nonwoven web having essentially a uniform density, and then the nonwoven web is bonded to impart physical integrity and strength. The processes for producing spunbond fibers and webs therefrom are disclosed, for example, in U.S. Pat. Nos. 4,340,563 to Appel et al., 3,802,817 to Matsuki et al. and 3,692,618 to Dorschner et al. A particularly suitable conjugate spunbond fiber web production process is disclosed in commonly assigned U.S. patent application Ser. No. 07/933,444, U.S. Pat. No. 5,382,400 to Pike et al. filed Aug. 21, 1992. The term "staple fibers" refers to noncontinuous fibers. Staple fibers are produced with a conventional fiber spinning process and then cut to a staple length, from about 1 inch to about 8 inches. Such staple fibers are subsequently carded, wet-laid, or air-laid and then thermally bonded to form a nonwoven web. The term "meltblown webs" refers to nonwoven webs formed by extruding a molten thermoplastic polymer through a spinneret containing a plurality of fine, usually circular, die capillaries as molten filaments or fibers into a high velocity, usually heated gas stream which attenuates or draws the filaments of molten thermoplastic polymer to reduce their diameter. After the fibers are formed, they are carried by the high velocity gas stream and are deposited on a forming surface to form an autogenously bonded web of randomly disbursed, highly entangled meltblown microfibers. Such a process is disclosed, for example, in U.S. Pat. 3,849,241 to Butin. Typically, the polymer chains of meltblown fibers are not highly oriented, and thus meltblown fibers exhibit substantially weaker strength properties when compared to spunbond and staple fibers.

DETAILED DESCRIPTION OF THE INVENTION

The present invention provides a nonwoven pad that is highly suitable for impregnating a large amount of topically appliable, surface active agents and is highly adapted for evenly and selectively releasing the impregnated active agents. The nonwoven pad is also highly suitable for buffing and polishing applications. The pad is produced from a nonwoven web that contains crimped spunbond or staple conjugate fibers, and the conjugate fibers have at least two component polymers having different melting points. The fibers have an average diameter between about 8 μm and about 50 μm, desirably between about 10 μm and about 30 μm. The structure of a suitable nonwoven web for the present invention can be characterized as having autogenous interfiber bonds at the crossover contact points of the fibers throughout the nonwoven web. The nonwoven web, which contains crimped fibers and interfiber bonds, has a structure that is lofty and yet compressibly resilient. Alternatively stated, the nonwoven web is flexible and readily compressible and yet upon release of compacting pressure, essentially completely recovers to the initial uncompressed structure. The nonwoven webs suitable for the present invention typically have a density between about 0.01 g/cm$^3$ and about 0.1 g/cm$^3$, desirably between about 0.02 g/cm$^3$ to about 0.9 g/cm$^3$, and a basis weight of about 0.3 ounces per square yard (osy) to about 20 osy (about 10 to about 680 g/m$^2$), desirably about 0.5 osy to about 15 osy (about 17 to about 510 g/m$^2$). Desirably, the total void space of the suitable nonwoven webs occupies between about 80% and about 99%, more desirably between about 85% and about 98.5%, of the total volume of the nonwoven webs.

Suitable conjugate fibers for the nonwoven pad contain at least two component polymers that have different melting points. The component polymers occupy distinct cross sections along substantially the entire length of the fibers, and the cross section that contains the lowest melting component polymer occupies at least some portion, desirably at least half, of the peripheral surface of the fibers. Suitable conjugate fibers may have a side-by-side configuration or sheath-core configuration, e.g., eccentric configuration or concentric configuration. Of the sheath-core configurations, particularly suitable are eccentric configurations in that they are more amenable to crimp imparting processes.

In accordance with the present invention, the crimp level of the conjugate fibers can be changed to impart different properties to the web, including different density, strength, softness and texture, as well as the active agent retaining capacity of the nonwoven web. In general, a nonwoven web containing fibers having a higher crimp level provides a loftier and lower density structure that is highly adapted for carrying a larger amount of active agents and for carrying higher viscosity fluids. In addition, crimps in the fibers impart a soft, cloth-like texture in the web. Desirably, suitable fibers for the present nonwoven web have at least about 2 crimps per extended inch (2.54 cm), particularly between about 2 and about 50 crimps per extended inch, more particularly between about 5 and about 30 crimps per extended inch, as measured in accordance with ASTM D-3937-82.

The component polymers of suitable conjugate fibers desirably are selected to have a melting point difference between the highest melting component polymer and the lowest melting component polymer of at least about 5° C., more desirably at least about 10° C., most desirably at least about 30° C., such that the lowest melting component polymer can be melted and rendered adhesive without melting the higher melting component polymers of the fibers, thereby the difference in the melting points can be advantageously used to bond nonwoven webs containing the conjugate fibers. When a nonwoven web containing the conjugate fibers is heated to a temperature equal to or higher than the melting point of the lowest melting component polymer but below the melting point of the highest melting component polymer, the melted portions of the fibers form autogenous interfiber bonds, especially at the crossover contact points, throughout the web while the high melting polymer portions of the fibers maintain the physical and dimensional integrity of the web. Desirably, the component polymers are selected additionally to have different crystallization and/or solidification properties to impart latent crimpability in the fibers. While it is not wished to limit the invention to a particular theory, it is believed that, in general, conjugate fibers containing component polymers of different crystallization and/or solidification properties possess subsequently activatable "latent crimpability". The latent crimpability is imparted in the conjugate fibers because of incomplete crystallization of one or more of the slow crystallizing component polymers. When such conjugate fibers are exposed to a heat treatment or mechanical drawing process, the component polymers further crystallize. The crystallization disparity among the component polymers of the conjugate fibers during the subsequent crystallization process causes the fibers to crimp, unless the component polymers of the fibers are concentrically arranged and thus dimensionally restrained from forming crimps.

An exemplary process for producing highly suitable spunbond conjugate fibers having such latent crimpability and nonwoven webs containing the conjugate fibers is disclosed in commonly assigned U.S. patent application Ser. No. 07/933,444, U.S. Pat. No. 5,382,400 to Pike et al. filed Aug. 21, 1992, which in its entirety is herein incorporated by reference. Briefly, the process for making crimped conjugate fiber web disclosed in the patent application includes the steps of meltspinning continuous multicomponent polymeric filaments, at least partially quenching the multicomponent filaments so that the filaments have latent crimpability, activating the latent crimpability and drawing the filaments by applying heated drawing air, and then depositing the crimped, drawn filaments onto a forming surface to form a nonwoven web. The spunbond fiber forming process of the patent application is particularly desirable for the present nonwoven web in that the heated air crimping and drawing process provides a convenient way to impart crimps and control the crimp density, i.e., the number of crimps per unit length of a fiber. In general, a higher drawing air temperature results in a higher number of crimps.

As indicated above, the deposited nonwoven web is bonded by heating the conjugate fiber web to melt or render adhesive the lowest melting component polymer of the conjugate fibers and, thus, allowing the fibers to form interfiber bonds, especially at cross over contact points of the fibers. Bonding processes suitable for the present invention include through-air-bonding processes, oven bonding processes and infrared bonding processes. Of these, particularly suitable are through-air-bonding processes that apply a penetrating flow of heated air through the nonwoven web to quickly and evenly raise the temperature of the web. In addition, through-air-bonding processes can be modified to impart a fiber density gradient in the nonwoven web during the bonding process. When a high flow rate of heated air is applied onto the nonwoven web during the bonding process, the compacting pressure of the air flow and the weight of the fibers create an increasing fiber density gradient in the direction of the air flow, forming a bonded nonwoven web having a fiber density gradient. A nonwoven web having an increasing fiber density gradient in the direction of its thickness provides two distinct surfaces having different textural and physical properties, a low fiber density surface and a high fiber density surface. In general, the low fiber density surface of such bonded nonwoven webs provides a soft surface that is suited for applying the impregnated active agent, while the high fiber density surface provides a more rigid, abrasion resistant surface that is suited for buffing and scrubbing actions.

As a particularly desirable embodiment of the present invention, nonwoven webs suitable for the nonwoven pad are produced from a nonwoven web of crimped spunbond conjugate filaments. As stated above, the crimp level and, thus, the interfiber void structure of spunbond conjugate filament nonwoven webs can be conveniently controlled during the production process, providing a highly controllable in-situ process for conveniently producing customized or particularized nonwoven webs for various pad applications to accommodate different types and viscosities of active agents. In addition, spunbond nonwoven processes, unlike staple fiber web forming processes, do not have separate filament cutting, i.e., staple fiber forming, and web-forming steps, thereby making the processes more economical than the processes for forming staple fiber webs. Furthermore, the continuous filaments of spunbond nonwoven webs tend to provide higher strength nonwoven webs than staple fiber webs and are less likely to produce lint, i.e., loose fibers, that may interfere with the performance of the pad.

Conjugate fibers suitable for the present invention can be produced from a wide variety of thermoplastic polymers that are known to form fibers. The component polymers are selected in accordance with the above-described selection criteria including melting points and crystallization properties. Suitable polymers for the present invention are selected from polyolefins, polyamides, polyesters, copolymers containing acrylic monomers, and blends and copolymers thereof. Suitable polyolefins include polyethylene, e.g., linear low density polyethylene, high density polyethylene, low density polyethylene and medium density polyethylene; polypropylene, e.g., isotactic polypropylene, syndiotactic polypropylene, blends thereof and blends of isotactic polypropylene and atactic polypropylene; and polybutylene, e.g., poly(1-butene) and poly(2-butene); polypentene, e.g., poly-4-methylpentene-1 and poly(2-pentene); as well as blends and copolymers thereof. Suitable polyamides include nylon 6, nylon 6/6, nylon 10, nylon 4/6, nylon 10/10, nylon 12, nylon 6/12, nylon 12/12, and hydrophilic polyamide copolymers such as copolymers of caprolactam and an alkylene oxide, e.g., ethylene oxide, and copolymers of hexamethylene adipamide and an alkylene oxide, as well as blends and copolymers thereof. Suitable polyesters include polyethylene terephthalate, polybutylene terephthalate, polycyclohexylenedimethylene terephthalate, and blends and copolymers thereof. Acrylic copolymers suitable for the present invention include ethylene acrylic acid, ethylene methacrylic acid, ethylene methylacrylate, ethylene ethylacrylate, ethylene butylacrylate and blends thereof. Particularly suitable polymers for the present invention are polyolefins, including polyethylene, e.g., linear low density polyethylene, low density polyethylene, medium density polyethylene, high density polyethylene and blends thereof; polypropylene; polybutylene; and copolymers as well as blends thereof. Of the suitable polymers, particularly suitable polymers for the high melting component of conjugate fibers include polypropylene, copolymers of polypropylene and ethylene and blends thereof, more particularly polypropylene; and particularly suitable polymers for the low melting component include polyethylenes, more particularly linear low density polyethylene, high density polyethylene and blends thereof. In addition, the polymer components may contain additives or thermoplastic elastomers for enhancing the crimpability and/or lowering the bonding temperature of the fibers, and enhancing the abrasion resistance, strength and softness of the resulting webs. For example, the low melting polymer component may contain about 5 to about 20% by weight of a thermoplastic elastomer such as an ABA' block copolymer of styrene, ethylene-butylene and styrene. Such copolymers are commercially available and some of which are identified in U.S. Pat. No. 4,663,220 to Wisneski et al. An example of highly suitable elastomeric block copolymers is KRATON G-2740. Another group of suitable additive polymers is ethylene alkyl acrylate copolymers, such as ethylene butyl acrylate, ethylene methyl acrylate and ethylene ethyl acrylate, and the suitable amount to produce the desired properties is from about 2 wt % to about 50 wt %, based on the total weight of the low melting polymer component. Yet other suitable additive polymers include polybutylene copolymers and ethylenepropylene copolymers.

In accordance with the present invention, two-component conjugate fibers, bicomponent fibers, are particularly useful for the invention, and suitable bicomponent fibers have from about 10% to about 90%, desirably from about 20% to about 80%, more desirably from about 40% to about 60%, by weight of a low melting polymer and from about 90% to about 10%, desirably from about 80% to about 20%, more desirably about 60% to about 40%, by weight of a high melting polymer.

The conjugate fiber nonwoven pads of the present invention in general are oleophillic since most of the above-illustrated suitable fiber-forming polymers are naturally oleophillic. Consequently, oil based active agents and emulsified active agents are readily absorbed and retained by the present nonwoven web. When aqueous or hydrophilic active agents are desired to be impregnated in the nonwoven pad, the conjugate fibers or the nonwoven web that forms the pad may be hydrophilically modified. Any of a wide variety of surfactants, including ionic and nonionic surfactants, may be employed to hydrophilically modify the pad. Suitable surfactants may be internal modifiers, i.e., the modifying compounds are added to the polymer composition prior to spinning or forming fibers, or topical modifiers, i.e., the modifying compounds are topically applied during or subsequent to the formation of fibers or nonwoven webs. An exemplary internal modification process is disclosed in U.S. Pat. No. 4,578,414 to Sawyer et al. An exemplary topical modification process is disclosed in U.S. Pat. No. 5,057,361 to Sayovitz et al. Both of the patents are herein incorporated by reference. Illustrative examples of suitable surfactants include silicon based surfactants, e.g., polyalkylene-oxide modified polydimethyl siloxane; fluoroaliphatic surfactants, e.g., perfluoroalkyl polyalkylene oxides; and other surfactants, e.g., actyl-phenoxypolyethyoxy ethanol nonionic surfactants, alkylaryl polyether alcohols, and polyethylene oxides. Commercially available surfactants suitable for the present invention include various poly(ethylene oxide) based surfactants available under the tradename Triton, e.g., grade X-102, from Rohm and Haas Crop; various polyethylene glycol based surfactants available under the tradename Emerest, e.g., grades 2620 and 2650, from Emery Industries; various polyalkylene oxide modified polydimethylsiloxane based surfactants available under the tradename Silwet, e.g., grade Y12488, from OSI Specialty Chemicals; and alkenyl succinamide surfactants available under the tradename Lubrizol, e.g., grade OS85870, from Lubrizol Crop.; and polyoxyalkylene modified fluoroaliphatic surfactants available from Minnesota Mining and Manufacturing Co. The amount of surfactants required and the hydrophilicity of modified fibers for each application will vary depending on the type of surfactant selected and the component polymers used. In general, the surfactant may be added, topically or internally, in the range of from about 0.1 to about 5%, desirably from about 0.3% to about 4%, by weight based on the weight of the fiber or the nonwoven web.

In accordance with the present invention, a wide variety of topically appliable active agents can be impregnated in and used with the present nonwoven pad, which include synthetic oil based active agents, e.g. paraffin wax, shoes and garment polishing waxes and mineral oil; natural active agents, e.g., bees wax, carnauba wax, candelilla wax, and castor oil; emulsified active agents, e.g., soaps, detergents, body lotions and wax emulsions; aqueous active agents, e.g., dermatological medicaments, germicidal solutions and bleaches; and others, e.g., alcohols, perfumes and dermatological cleansers.

The active agents can be impregnated into the nonwoven pad by any conventional techniques useful for impregnating or applying liquid on a porous material, such as spraying, dipping, coating and printing. Optionally, once the nonwoven pad is impregnated with an active agent, the liquid content of the agent can be evaporated to provide highly stable and low weight nonwoven pads that can be reactivated by subsequently applying an appropriate solvent or water.

The treated nonwoven pads of the present invention are highly suitable for carrying and evenly applying topically appliable active agents. The nonwoven pads are particularly suited for high viscosity active agents, e.g., polishing wax, that cannot be impregnated in a large amount in and are not easily released from prior art microfiber nonwoven webs and cellulosic natural fiber webs that have small interfiber capillary structures which firmly hold the active agents and hinders the exuding movement of the agents from the web even when pressure is applied. The highly porous and lofty structure of the present nonwoven pads provides a unique void structure that is excellent for absorbing and carrying a large amount of active agents, and the resilient property of the nonwoven pad allows selective, i.e., in response to varying degrees of applied pressure, and thorough release of the absorbed agents. In addition, the high resiliency and the relatively large void structure, compared to microfiber webs, of the present pad promote the release and reabsorption of absorbed active agents in response to hand pressure. Moreover, the nonwoven pad which contains evenly distributed autogenous interfiber bonds exhibits high abrasion resistance and physical strength that are highly useful for applying the active agent over a large area, applying the absorbed agent over even a rough surface, and buffing or polishing a surface without scratches or abrasions. Additionally, the strength of the interfiber bonds which are formed by the component polymer of the fibers of the nonwoven web, and not by an externally applied adhesive, is generally not affected by the impregnated active agent, i.e., the nonwoven pad exhibits unimpaired wet strength. Consequently, the present nonwoven web is highly useful for various active agent applying and buffing applications. Yet another advantageous characteristic of the pad is that the crimped fibers and the autogenously bonded interfiber structure of the pad provide cloth-like pleasing textural properties. The nonwoven pad having these useful properties can be used as a carrier and non-abrading applicator of a wide variety of active agents, including automotive polishing agents, waxes, cosmetic compounds, topical medicaments, cleansers, moisturizers, fragrances, germicidal solutions and the like, as well as a buffing or polishing pad for the active agents.

As an additional embodiment of the present invention, the conjugate fibers forming the nonwoven web may have a variety of different cross sectional shapes in addition to the conventional round shape in order to impart additional advantageous functionalities in the nonwoven web, such as increased active agent holding capacity and improved active agent holding stability. Suitable cross sectional shapes include ribbon, bilobal, trilobal, quadlobal, pentalobal and hexalobal shapes. Methods of forming shaped fibers are known to those skilled in the art. As a general rule, shaped fibers are prepared by extruding the fiber compositions through a die orifice generally corresponding to the desired shape. Such a method is described, for example, in U.S. Pat. No. 2,945,739 to Lehmicke.

As yet another embodiment of the present invention, the nonwoven pad can be laminated to variety of different materials. For example, the pad can be laminated to a liquid barrier layer, e.g., film layer, so that the impregnated agent is released only through the nonwoven side of the pad. The pad can also be laminated to a scouring or abrasive layer, e.g., a steel wool, so that the large active agent holding capacity and the strength properties can be complementarily added to a highly abrasive property of the abrasive material. As yet another embodiment of the present invention, the high strength nonwoven pad can be impregnated with an abrasive compound, e.g., metal polishing agent or abrasive particles, to be used as a hard surface polishing pad.

The following examples are provided for illustration purposes and the invention is not limited thereto.

EXAMPLES

Example 1

(Ex1)

A 3 osy (102 g/m$^2$) spunbond bicomponent fiber web was produced using the production process disclosed in aforementioned U.S. patent application Ser. No. 07/933,444. A linear low density polyethylene (LLDPE), Aspun 6811A, which is available from Dow Chemical, was blended with 2 wt % of a $TiO_2$ concentrate containing 50 wt % of $TiO_2$ and 50 wt % of a polypropylene, and the blend was fed into a first single screw extruder. A polypropylene, PD3445, which is available from Exxon, was blended with 2 wt % of the above-described $TiO_2$ concentrate, and the blend was fed into a second single screw extruder. The extruded polymers were spun into round bicomponent fibers having a side-by-side configuration and a 1:1 weight ratio of the two component polymers using a bicomponent spinning die, which had a 0.6 mm spinhole diameter and a 6:1 L/D ratio. The melt temperatures of the polymers fed into the spinning die were kept at 450° F. (232° C.), and the spinhole throughput rate was 0.6 gram/hole/minute. The bicomponent fibers exiting the spinning die were quenched by a flow of air having a flow rate of 45 standard feet$^3$/minute/inch (0.5 m$^3$/minute/cm) spinneret width and a temperature of 65° F. (18° C.). The quenching air was applied about 5 inches (13 cm) below the spinneret, and the quenched fibers were drawn in an aspirating unit of the type which is described in U.S. Pat. No. 3,802,817 to Matsuki et al. The aspirator was equipped with a temperature controlled aspirating air source, and the feed air temperature was kept at about 350° F. (177° C.). The quenched fibers were drawn with the heated feed air to attain a 2.5 denier. Then, the drawn fibers were deposited onto a foraminous forming surface with the assist of a vacuum flow to form an unbonded fiber web. The unbonded fiber web was bonded by passing the web through a through-air bonder which is equipped with a heated air source. The heated air velocity and the temperature of the heated air were 200 feet/minute (61m/min) and 262° F. (128° C.), respectively. The residence time of the web in the hood was about 1 second. The resulting bonded web had a thickness of 0.14 inches (0.36 cm) and a density of 0.027 g/cm$^3$.

The bonded nonwoven web was cut into a 3 inch by 3 inch (7.6 cm×7.6 cm) square test specimens and weighed. The square pads were tested for its active agent absorbent and delivery capacities using a mineral oil, baby oil from Johnson and Johnson, and a liquid dish washing detergent. The pad specimen was submerged in a mineral oil bath or a soap bath for one minute, and then the soaked pad was taken out of the bath and allowed to drip excess fluid for one minute. The weight of the active agent impregnated pad was measured to determine the absorbent capacity of the nonwoven pad. Then the impregnated pad was placed on a metal block having a 3 inch by 3 inch (7.6 cm×7.6 cm) planar surface, and a 12 pound (5.4 kg) flat weight, which completely covered the pad and provided a 1.2 psi (0.08 kg/cm$^3$) pressure, was placed over the pad squeezing the active agent out from the pad. The released active agent was allowed to flow away from the pad. Again, the pad was weighed to determine the amount of the active agent released (delivered) under the pressure. The results are shown in Table 1.

Comparative Example 1

(C1)

A meltblown web having a basis weight of 1.1 osy (37 g/m$^2$) was produced in accordance with the procedures described in U.S. Pat. No. 4,307,143 to Meitner. The web was produced by meltblowing polypropylene, which was obtained from Himont, grade PF015, through a die having a row of apertures and impinging heated air at the die exit to draw the filaments forming microfibers which were collected on a forming wire to form an autogenously bonded meltblown web. Because meltblown nonwoven webs typically do not have physical strength properties that are required for active agent delivery applications, the nonwoven webs were point bonded to have a total bonded surface area of 15%. The meltblown web was bonded by feeding the web into the nip of a steel calender roll and a steel anvil roll. The calender roll had about 117 raised square bonding points per square inch (18 points/cm$^2$). The bonding rolls were heated to about 220° F. (104° C.) and applied a nip pressure of about 200 lbs/lineal inch (35 kg/lineal cm). The bond points of the bonded meltblown web virtually lost their fibrous structure and formed film-like regions. The bonded meltblown web was tested for the absorbent and delivery capacities in accordance with the procedure outlined in Example 1. The results are shown in Table 1.

Comparative Example 2

(C2)

Comparative example 1 was repeated, except a 2 osy (68 g/m$^2$) meltblown web was prepared and tested for this comparative example.

TABLE 1

| | Web | | Absorbent | Amount Delivered under applied pressure | |
|---|---|---|---|---|---|
| | Density (g/cc) | Fluid | Capacity (g/g) | Amount (g/g) | % of Absorbed (%) |
| Ex1 | 0.027 | Oil | 20.1 | 10.7 | 53 |
| | | Soap | 32.8 | 19.8 | 60 |
| C1 | 0.089 | Oil | 6.3 | 2.0 | 32 |
| | | Soap | 14.5 | 8.2 | 57 |
| C2 | 0.096 | oil | 6.0 | 1.9 | 32 |
| | | Soap | 12.0 | 6.1 | 51 |

Absorbent Capacity = weight of the active agent absorbed per unit weight of the nonwoven web.
Amount Delivered = weight of the active agent released under pressure per unit weight of the nonwoven web.

The capacity results show that the present conjugate fiber nonwoven web has a significantly higher absorbent capacity compared to meltblown nonwoven webs and that the conjugate fiber web more readily releases the absorbed active agent in response to applied pressure. The results demonstrate that the present conjugate fiber nonwoven web has an interfiber structure that is highly suitable for absorbing or carrying and delivering various active agents. Although it is not wished to be bound by any theory, it is believed that meltblown fiber webs and natural fiber webs tend to have a small interfiber capillary structure that does not accept a large amount of active agents and does not readily release the agents once they are absorbed into the capillary structure. In contrast, the large interfiber void configuration, high resiliency and strength of the present conjugate fiber web provide a unique web structure that makes the present nonwoven web highly suitable for active agent delivery systems.

Example 2

(Ex2)

A 2 osy bicomponent nonwoven web was prepared in accordance with Example 1. The nonwoven web was tested for its grab tensile strength in accordance with Federal Standard Methods 191A, Method 5100 (1978). The grab test for tensile strength measures the breaking load a nonwoven web at a constant rate of extension in the machine direction (MD) or the cross-machine direction (CD). The results are shown in Table 2.

Comparative Example 3

(C3)

The meltblown web of Comparative Example 1 was tested for its grab tensile strength. The results are shown in Table 2.

TABLE 2

| Example | Grab Tensile MD (lbs) | Grab Tensile CD (lbs) |
|---|---|---|
| Ex2 | 16 | 15 |
| C3 | 4 | 3 |

As can be seen from the above results, the present conjugate fiber web exhibits high strength properties compared to the meltblown web even though the meltblown web was point bonded to improve the strength properties. Correspondingly, in combination with other advantageous properties, e.g., high resiliency, abrasion resistance and absorbency, the nonwoven web is an excellent material for buffing and polishing applications as well as active agent delivery applications. In addition, the conjugate fiber nonwoven web is a nonabrasive buffing or polishing material that is gentle to the target surface since the nonwoven web itself does not contain any abrasive components. However, because of the advantageous strength and absorbent properties of the nonwoven web, the web can easily be modified as an abrading pad by impregnating it with an abrasive material, e.g., calcium carbonate particles, iron particles or sand.

What is claimed is:

1. A treated pad comprising a nonwoven web that comprises crimped conjugate fibers, said conjugate fibers selected from spunbond fibers and staple fibers, and said nonwoven web containing autogenous interfiber bonds at the crossover contact points of said fibers throughout said web, wherein said nonwoven pad is impregnated with a topically appliable active agent.

2. The treated pad of claim 1 wherein said conjugate fibers comprises at least two component polymers selected from polyolefins, polyamides, polyesters, acrylic copolymers, and blends and copolymers thereof.

3. The treated pad of claim 2 wherein said conjugate fibers comprises polyethylene and polypropylene.

4. The treated pad of claim 3 wherein said conjugate fibers are spunbond fibers.

5. The treated pad of claim 1 wherein said topically appliable active agent is selected from polishing agents, waxes, cosmetic compounds, topical medicaments, cleansers, moisturizers, fragrances and germicidal solutions.

6. The treated pad of claim 1 wherein said nonwoven web is hydrophilically modified.

7. The treated pad of claim 6 wherein said nonwoven web is modified with a surfactant.

8. The treated pad of claim 1 wherein said nonwoven web is laminated to a barrier layer.

9. The treated pad of claim 1 wherein said nonwoven web is laminated to an abrasive layer.

10. The treated pad of claim 1 wherein said nonwoven web has a basis weight between about 0.3 and about 20 ounce per square yard and a density between about 0.01 $g/cm^3$ and about 0.1 $g/cm^3$.

11. The treated pad of claim 1 wherein said conjugate fibers have a side-by-side configuration.

12. The treated pad of claim 1 wherein said nonwoven web is through-air bonded.

13. An active agent impregnated pad comprising a nonwoven web that comprises conjugate fibers, said conjugate fibers selected from spunbond fibers and staple fibers, said fibers having at least 2 crimps per extended inch as measured in accordance with ASTM D-3937-82, and said nonwoven web containing autogenous interfiber bonds at the crossover contact points of said fibers throughout said web, wherein said nonwoven pad is impregnated with a topically appliable active agent.

14. The pad of claim 13 wherein said conjugate fibers comprises at least two component polymers selected from polyolefins, polyamides, polyesters, acrylic copolymers, and blends and copolymers thereof.

15. The pad of claim 14 wherein said conjugate fibers comprises polypropylene and polyethylene.

16. The pad of claim 15 wherein said conjugate fibers are spunbond fibers.

17. The pad of claim 13 wherein said topically appliable active agent is selected from polishing agents, waxes, cosmetic compounds, topical medicaments, cleansers, moisturizers, fragrances and germicidal solutions.

18. The pad of claim 13 wherein said nonwoven web is hydrophilically modified.

19. A nonwoven polishing pad comprising a layer of a nonwoven web and a layer selected from barrier layers and abrasive layers, said nonwoven web comprising crimped conjugate fibers selected from spunbond fibers and staple fibers, said conjugate fibers having at least 2 crimps per extended inch as measured in accordance with ASTM D-3937-82, and said nonwoven web containing autogenous interfiber bonds at the crossover contact points of said conjugate fibers throughout said web.

20. The polishing pad of claim 19 wherein said conjugate fibers comprises at least two component polymers selected from polyolefins, polyamides, polyesters, acrylic copolymers, and blends and copolymers thereof.

21. The polishing pad of claim 19 wherein said conjugate fibers are spunbond fibers.

* * * * *